US005833523A

United States Patent [19]

Hykes

[11] Patent Number: 5,833,523

[45] Date of Patent: Nov. 10, 1998

[54] VARIABLE VOLUME COOLANT SYSTEM

[76] Inventor: Timothy W. Hykes, 14101 Molly Pitcher Hwy., Greencastle, Pa. 17225

[21] Appl. No.: 697,984

[22] Filed: Sep. 3, 1996

[51] Int. Cl.[6] ..... B24B 55/02

[52] U.S. Cl. ..... 451/450; 451/547

[58] Field of Search ..... 451/547, 62, 58, 451/46, 173, 11, 163, 239, 25, 307, 450; 83/169, 171; 137/240, 883, 601, 602

[56] References Cited

U.S. PATENT DOCUMENTS

| | | | |
|---|---|---|---|
| 2,140,838 | 12/1938 | Hart . | |
| 2,434,679 | 1/1948 | Wagner et al. . | |
| 2,475,811 | 7/1949 | Wagner et al. . | |
| 2,730,845 | 1/1956 | Ernst | 451/49 |
| 2,924,873 | 2/1960 | Knowles . | |
| 3,341,983 | 9/1967 | Baldenhofer et al. | 451/450 |
| 3,423,887 | 1/1969 | Strom et al. | 451/49 |
| 3,570,332 | 3/1971 | Beake | 451/450 |
| 3,628,293 | 12/1971 | Kobayashi et al. | 451/450 |
| 3,638,366 | 2/1972 | Gamache . | |
| 3,696,564 | 10/1972 | Joyce | 451/450 |
| 3,905,161 | 9/1975 | Tomita et al. | 451/450 |
| 3,952,458 | 4/1976 | Tomita et al. | 451/450 |
| 4,197,678 | 4/1980 | Roll et al. . | |
| 4,292,766 | 10/1981 | Kirk et al. | 451/249 |
| 4,314,425 | 2/1982 | Bricker et al. | 451/450 |
| 4,315,384 | 2/1982 | Roos . | |
| 4,529,340 | 7/1985 | O'Dell . | |
| 4,622,780 | 11/1986 | Tingley . | |
| 4,929,130 | 5/1990 | Diebolt et al. . | |
| 5,228,369 | 7/1993 | Itoh et al. . | |
| 5,482,497 | 1/1996 | Gonnella et al. | 451/58 |

*Primary Examiner*—Timothy V. Eley
*Assistant Examiner*—Derris Banks
*Attorney, Agent, or Firm*—Hoffman, Wasson & Gitler

[57] ABSTRACT

A variable volume coolant system for delivering liquid coolant to the interface defined between a machine tool and a workpiece to be abraded to a desired size and curvature. A first conduit path is defined between a source of liquid coolant and a nozzle for delivering coolant to the gap defined between the machine tool and the workpiece; a second conduit path is also defined between the source of liquid coolant and the nozzle. A first valve, such as a solenoid valve, controls the flow of liquid coolant through the first conduit path, while a second valve performs the same function for the second conduit path. The first conduit path possesses a greater volume than the second conduit path. By selectively adjusting the first and second valves, a high volume flow of liquid coolant is maintained over most of the machining operation, while a greatly diminished, low volume flow is established toward the completion of the machining operation. The coolant system is always "on", so that some liquid coolant reaches the gap. In summary, the foregoing system functions to vary the volume of coolant delivered to the tool-workpiece interface at different points in time; high volumes of liquid coolant are delivered during high stock removal points in the machining operation, or cycle, and low volumes of coolant are delivered when stock removal is low and the final geometry of the workpiece is being created.

17 Claims, 1 Drawing Sheet

VARIABLE VOLUME COOLANT SYSTEM

FIELD OF THE INVENTION

This invention pertains generally to systems for delivering liquid coolants to the interface defined between a machine tool and a workpiece to be abraded to a desired size and curvature. More particularly, this invention relates to a system that delivers variable volumes of coolant, at different times, in the cycle of operation of the machine tool.

BACKGROUND OF THE INVENTION

Systems for delivering liquid coolants, such as water, oil, or combinations thereof, to rotating tools, such as grinding wheels, are well known. Such systems usually deliver the liquid coolant, through a nozzle situated in proximity to the grinding wheel. A pump withdraws the liquid coolant from a reservoir, and pressurizes same before its discharge through a strategically located nozzle. The liquid coolant serves many functions; for example, the coolant may cool the workpiece and lubricate the tool, or vice versa, and the coolant may drive away the debris or "swarf", formed between the tool and workpiece. The liquid coolant discharged, however, is usually constant in volume, and thus does not take into account different conditions that occur during the cycle of operation.

To illustrate, U.S. Pat. No. 2,140,838, Hart, discloses a coolant delivery system that supplies a cooling liquid, such as water, to a cutting tool, such as broach 16, 22, to cool, lubricate, and clear chips away from the tool. The coolant delivery system includes two pipes 24, 26 which are connected to pumps 28, 30; the two pipes are joined together in the vicinity of the working face of the broach, as shown in FIG. 2. A relatively large quantity of cooling fluid is delivered, under relatively low pressure, through pipe 24 to prevent overheating of the broach. Simultaneously, a relatively fine stream of relatively high velocity cooling fluid is directed through pipe 26 to forcibly drive chips out of, and away from, the face of the broach.

As another example of known coolant systems for tools, such as cutting tools, U.S. Pat. No. 5,228,369, Itoh et al, discloses an assembly for machining a substrate surface of a photoreceptor 1, such as a drum for a photocopier, laser printer, or the like. The assembly supplies cutting lubricant from a reservoir 5 to the cutting tool 3 for the assembly. The method of machining calls for measuring the temperature of the cutting tool by a sensor 4, such as a thermocouple, and control of both the temperature and flow rate, by temperature control unit 6 and flow control unit 7. The control unit 6 is responsive to the cutting tool temperature and suppresses a temperature fluctuation of the cutting tool, as suggested in FIG. 6.

Another known coolant delivery system is disclosed in U.S. Pat. No. 2,434,679, Wagner et al, which discloses a system that supplies low pressure liquid over pipeline 3 to nozzle 12, while simultaneously supplying high pressure liquid over pipeline 25 to nozzles 19, 20, 21. The high pressure nozzles are located within the low pressure nozzle 12, as shown in FIG. 5, and the nozzles discharge the two coolant liquids, at the same time, from the common outlet at the lower end of nozzle 12. Two separate liquids, such as water and oil, are used, for cooling and lubricating. The liquids are immiscible, and are kept separate, by using individual recirculation loops.

SUMMARY OF THE INVENTION

In contrast to known fixed volume systems used for delivering coolant to the interface between a machine tool, such as a grinding wheel, and a workpiece, such as a camshaft, crankshaft, or the like, the instant invention discloses a method for delivering variable volumes, of liquid coolant, at different times in the machining cycle. The novel method correlates the volume of fluid to be delivered, to the amount of metal remaining to be removed, or to the rate at which said metal is removed, before the machining operation is completed. By reducing the volume of liquid coolant discharged as the machining operation approaches its conclusion, the instant invention permits the grinding wheel to snugly contact the workpiece to obtain closer tolerances and more accurate geometry.

The system for implementing the instant invention relies upon two, or more, volume controlled paths for delivering liquid coolant from a common supply, such as a reservoir, or a supply line to a nozzle. The nozzle delivers large volumes of coolant during high stock removal points in the machining cycle, while the other path delivers low volumes of coolant when stock removal is low and the final geometry is being created. The low volume of coolant flow reduces the forces imposed on the workpiece by the coolant being pressed thereagainst by the machine tool, such as the grinding wheel. The coolant trapped in the V-shaped notch or gap defined between the workpiece and the machine tool transmits forces to the workpiece that hamper accurate machining thereof. The exceedingly tight tolerances required by automotive manufacturers sparked the need to investigate every potential avenue for improving tolerances, even by millionths of an inch.

Other advantages that are attributable to the instant, conceptually distinguishable system for delivering variable volumes of liquid coolants, at different times in the machining cycle, will become apparent to the skilled artisan from the appended drawings, when construed in harmony with the ensuing description.

DESCRIPTION OF A PREFERRED EMBODIMENT OF THE INVENTION

Figure 1:
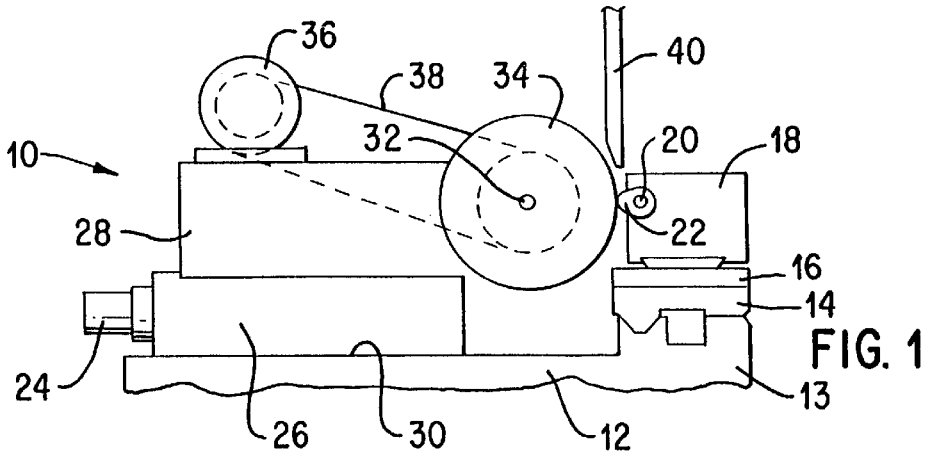
FIG. 1 is a schematic view of a machining system including a grinding wheel, a carriage to advance the grinding wheel into contact with a workpiece, and a nozzle for discharging coolant onto the workpiece and the grinding wheel.

FIG. 1 depicts a schematic representation of a conventional machine tool, such as a grinding machine, indicated generally by reference numeral 10. Machine 10 comprises a heavy metal base 12, that is secured in position on a factory floor. A front wall 13 extends upwardly from base 12, and a first slide 14 is situated atop wall 13. A second slide 16 rests atop plate 14, and a carriage 18 is movable transversely relative to slides 14, 16.

The carriage includes a head stock, a chuck on the headstock, a tail stock, and a second chuck on the tail stock, and a drive spindle for driving the head stock and the tail stock, but such components are omitted from FIG. 1. The opposite ends of the shaft 20 of the workpiece are inserted into, and grasped by the chucks, so that the eccentric surfaces 22 of the workpiece are retained in fixed position during machining operations.

Machine 10 also includes a drive motor 24, and a shaft and lead screw drive mechanism 26 for advancing wheel head carriage 28, along pad 30. Axle 32 of grinding wheel 34, which may be made of CBN or similar abrasive materials, is secured to carriage 28. Motor 24, when energized, advances, or retracts, wheel head carriage 28 in the longitudinal direction, so that wheel 34 can grind the eccentric surfaces 22 of the workpiece to the desired size and shape. Motor 36, via endless belt 38, delivers the motive power to wheel 34, for precise, high speed grinding, after the carriage 28 has been advanced to the proper position.

Nozzle 40 is positioned above the point of contact for the grinding wheel and the workpiece. The nozzle delivers liquid coolant, usually a water based fluid or oil, to the grinding wheel and to the workpiece, in order to cool same, and to wash away debris, commonly known as "swarf."

Figure 2:
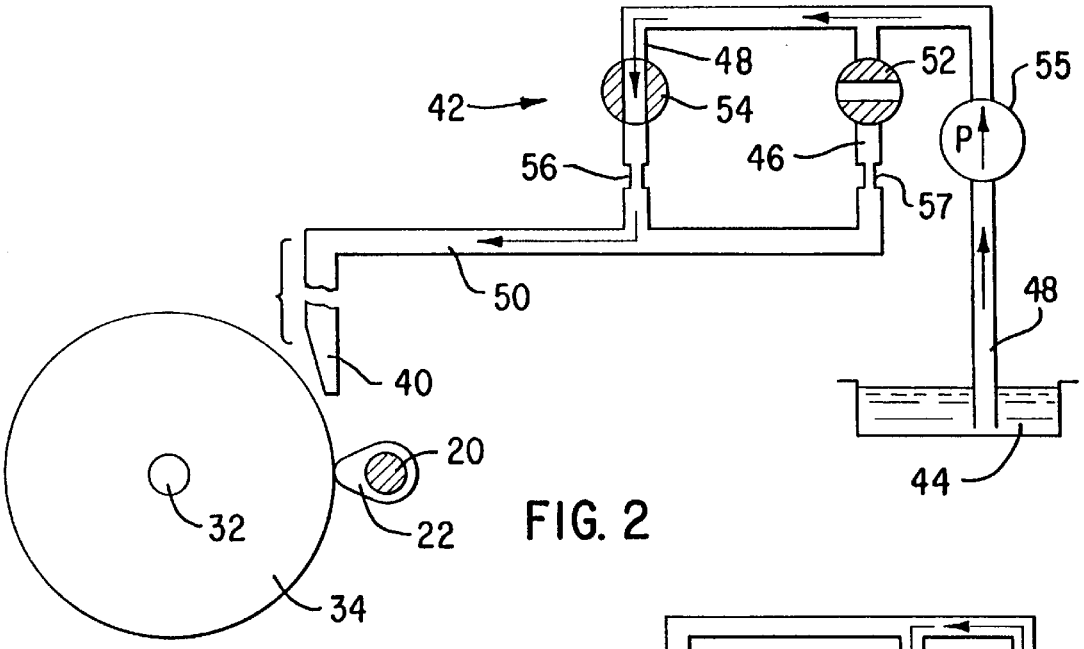
FIG. 2 is a schematic view, on an enlarged scale, of a control system, including two valves, for regulating the flow of coolant to the nozzle during high volume discharge.
Figure 3:
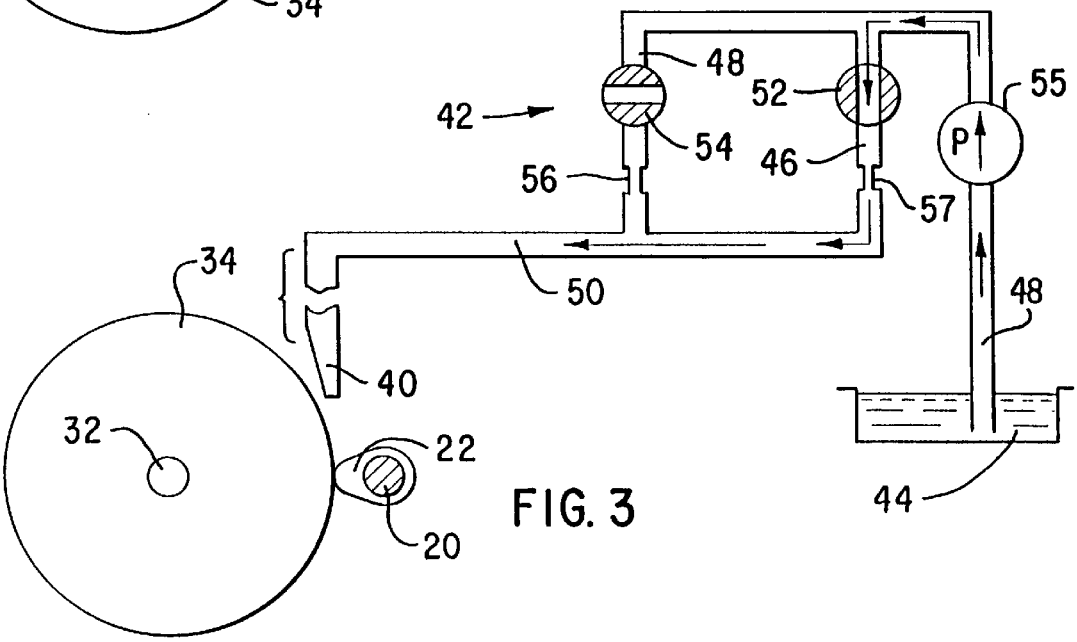
FIG. 3 is a similar view of the control system, but showing the two valves, in different conditions, during low volume discharge.

FIG. 2 and FIG. 3 show, in a schematic manner, the flow control system 42 for delivering a variable volume of coolant to nozzle 40 for discharge. The flow control system includes a reservoir 44, or other common pressure source, connected to conduits 46, 48 that lead into common pipe 50 that terminates in nozzle 40. A first valve 52 is situated in conduit 46, while a second valve 54 is situated in conduit 48. Flow restricting components, such as restrictor 56 in line 48, are connected in series with valve 54.

FIG. 2 shows valve 54 in its open condition, while valve 52 is in its closed position. Pump 55 causes liquid coolant to flow from reservoir 44 through conduit 48, valve 54, restrictor 56, into common pipe 50, and thence into nozzle 40. Such flow path for liquid coolant allows high volume discharge, for an extended period of time over the stock removal phase of the machining operation.

The coolant forms a hydrodynamic wedge between the workpiece 20, 22 and the grinding wheel 34. The forces pressing the machine tool, such as grinding wheel 34, against the workpiece, such as cam or lobe 22 on camshaft 20, are far greater than the forces represented by the hydrodynamic wedge, so that the wedge has negligible impact on the stock removing phase of the machining operation.

However, as the workpiece 20, 22 approaches its final size and geometry, the hydrodynamic wedge interferes with the capability of the machine to properly shape the workpiece, in its final phase. To overcome the effect of the wedge, and to obtain the desired workpiece size and geometry, flow control system 42 reverses the orientation of valves 52 and 54. As shown in FIG. 3, valve 54 is shut to block flow through conduit 48, while valve 52 is opened to allow flow through conduit 46, into common pipe 50, and thence into nozzle 40. Flow restrictor components, such as restrictor 56 in line 48 and/or restrictor 57 in conduit 46, insure that a lesser volume of coolant reaches nozzle 40 to be discharged between the workpiece and machine tool. The lesser volume of coolant reduces the impact of the hydrodynamic wedge, and allows the machine tool to contact, or "kiss" the workpiece, so that the final few millionths of material can be removed with unparalleled accuracy.

Although FIG. 2 and FIG. 3 are only schematic drawings, the "normal" flow rate for the coolant, under normal operating conditions for a known machine tool, such as a grinding wheel, was 30 gallons per minute/inch. In contrast, the low flow rate of coolant was 5 gallons per minute/inch. Valves 52, 54, are, preferably, solenoid valves, and the operation and timing of such valves, is correlated with the cycle of operation for the machine tool. The utilization of two flow rates, increased the ability of the machine tool to control size and roundness by 20 millionths of an inch, a significant improvement in a highly competitive, and cost conscious, metal machining industry.

Although flow control system 42 is capable of discharging two distinct volumes of coolant, over two distinct paths leading to nozzle 40, the flow control system may be expanded, by using additional solenoid valves, or variable volume control valves, to discharge three or more distinct volumes of coolant. Additionally, although the variable volume coolant system is presented in cooperation with a grinding system, the coolant system is equally applicable to other machining systems. Furthermore, in practice, both valves 52, 54 are opened during high volume operation, so that the total volume of coolant delivered by nozzles 40 is the sum of both flow paths. This procedure guarantees that there is no "dry" period when the coolant system is switched to low volume, for low volume flow may be maintained at all times during the machining cycle. Consequently, the appended claims should be broadly construed, and should not be limited to their literal terms.

I claim:

1. A system for delivering coolant to the working surfaces of a machine tool and a workpiece with eccentric surfaces to be machined to a desired size and shape, (a) said machine tool including a bed, a carriage, means on said carriage adapted to receive and retain the workpiece, said carriage being movable in a first direction along said bed, (b) a tool carriage, a machine tool secured to said tool carriage, and drive means mounted on said tool carriage for advancing said tool carriage in a second direction, perpendicular to said first direction, so that said tool contacts said workpiece, (c) motor means on said tool carriage for driving said tool so that said tool abrades said workpiece, (d) a source of liquid coolant, a nozzle for delivering coolant to the gap defined between said machine tool and said workpiece, and conduit means connected between said source and said nozzle, (e) first valve manes for regulating the flow of coolant through said conduit means to deliver a first volume of liquid coolant through said nozzle into said gap during the machine operation, (f) second valve means for regulating the flow of coolant through said conduit means to deliver a second volume of liquid coolant through said nozzle into said gap during the machining operation, and (g) said second valve means being connected in series with a restriction in said conduit means to reduce the volume of coolant flow to a level less than the volume of flow through said first valve means.

2. The system of claim 1 wherein either said first valve means or said second valve means is open at all times so that coolant is delivered into the gap over the entire machining operation.

3. The system of claim 1 wherein said first and second valves are solenoid valves.

4. The system of claim 1 wherein said first and second valves are connected over said conduit means to the same, common source of liquid coolant.

5. The system of claim 1 wherein said first and second valves, when opened, allow coolant flow into a common pipe in said conduit means that leads to said nozzle.

6. A system for delivering coolant to the working surfaces of a machine tool and a workpiece with eccentric surfaces to be machined to a desired size and shape, a) said machine tool including a bed, a carriage, means on said carriage adapted to receive and retain the workpiece, said carriage being movable in a first direction along said bed, b) a tool carriage, a machine tool secured to said tool carriage, and drive means for advancing said tool carriage in a second direction, perpendicular to said first direction, so that said tool contacts said workpiece, c) motor means on said carriage for driving said machine tool so that said tool abrades said workpiece, d) a source of liquid coolant, a nozzle for delivering coolant to the gap defined between said, machine tool and said workpiece, and first and second conduit paths, of different volumes, connected between said source and said nozzle, e) first valve means for regulating the flow of coolant through said first conduit path to deliver a first volume of liquid coolant through said nozzle into said gap during the machining operation, f) second valve means for regulating the flow of cooling through said conduit means to deliver a second volume of liquid coolant through said nozzle into said gap during the machining operation, and g) said first and second conduit paths terminating in an inlet pipe that feeds into said nozzle, which is common to both conduit paths.

7. A system as defined in claim 6 wherein at least one of said valves is open during the machining operation so that a volume of liquid coolant is always present in the gap between the machine tool and workpiece.

8. A system as defined in claim 6 wherein flow restrictors are located in said second conduit path, in series with said second valve means, to further reduce the volume of coolant flow.

9. A system as defined in claim 6 wherein said first and second valve means comprise solenoid-operated valves.

10. A system for delivering fluid to the working surfaces of a machine tool and a workpiece to be machined to a desired size and shape, (a) said machine tool including a bed, a carriage, means on said carriage adapted to receive and retain the workpiece, the carriage being moveable along a first path with respect to said bed, (b) a tool carriage, a tool secured to said tool carriage, and drive means carried by said tool carriage for moving said tool carriage along a second path with respect to said first path, so that said tool contacts said workpiece, (c) operating means on said tool carriage for operating said tool so that said tool abrades said workpiece, (d) a source of fluid, a nozzle for delivering said fluid into a gap defined between said machine tool and said workpiece, and conduit means connected between said source and said nozzle, (e) valve means for regulating the flow of fluid through said conduit means to deliver a first volume of fluid through said nozzle into said gap during the machining operation, (f) said valve means further regulating the flow of fluid through said conduit means to deliver a second volume of fluid through said nozzle into said gap during the machining operation, and (g) said valve means includes a restriction connected in series in said conduit means to reduce the volume of fluid flow of fluid through said conduit means.

11. The system of claim 10, wherein said valve means including a first valve for delivering said first volume of fluid and a second valve for delivering said second volume of fluid, said first and second valves are connected by said conduit means to the same source of fluid.

12. The system of claim 10, wherein said valve means including a first valve for delivering said first volume of fluid and a second valve for delivering said second volume of fluid, said conduit means including a common pipe, said first and second valves, when opened, allow fluid flow into the common pipe in said conduit means that leads to said nozzle.

13. A system for delivering coolant to the working surfaces of a machine tool and a workpiece with eccentric surfaces to be machined to the desired size and shape, (a) said machine tool including a bed, a carriage, means on said carriage adapted to receive and retain the workpiece, said carriage being movable in a first direction along said bed, (b) a tool carriage, a tool secured to said tool carriage, and drive means for advancing said tool carriage in a second direction, perpendicular to said first direction, so that said tool contacts said workpiece, (c) motor means on said carriage for driving said machine tool so that said tool abrades said workpiece, (d) a source of liquid coolant, a nozzle for delivering coolant to the gap defined between said machine tool and said workpiece, and first and second conduit paths, of different volumes, connected between said source and said nozzle, (e) first valve means for regulating the flow of coolant through said first conduit path to deliver a first volume of liquid coolant through said nozzle into said gap during the machining operation, (f) second valve means for regulating the flow of coolant through said conduit means to deliver a second volume of coolant through said nozzle into said gap during the machining operation, and (g) said first and second conduit paths terminating in an inlet pipe that feeds into said nozzle, which is common to both conduit paths.

14. A system as defined in claim 1, wherein at least one of said valves is open during the machining operation so that a volume of fluid is always present in said gap between the machine tool and workpiece.

15. A system as defined in claim 1, wherein flow restrictors are located in said second conduit path, in series with said second valve means, to reduce the volume of coolant flow.

16. A system as defined in claim 1, wherein said first and second valve means comprise solenoid-operated valves.

17. The system as defined in claim 10 wherein said first and said second volumes of fluid are of unequal magnitude.

* * * * *

UNITED STATES PATENT AND TRADEMARK OFFICE

CERTIFICATE OF CORRECTION

PATENT NO. : 5,833,523

DATED : 11/10/98

INVENTOR(S) : Timothy HYKES

It is certified that error appears in the above-identified patent and that said Letters Patent is hereby corrected as shown below:

On the title page, please add --Assignee: Western Atlas Inc.--.

Signed and Sealed this

Tenth Day of August, 1999

*Attest:*

Q. TODD DICKINSON

*Attesting Officer*

*Acting Commissioner of Patents and Trademarks*